US012458836B2

(12) United States Patent
Meredith et al.

(10) Patent No.: US 12,458,836 B2
(45) Date of Patent: Nov. 4, 2025

(54) EXERCISE MACHINE WITH ADJUSTABLE RACK OUT HOOKS AND ADJUSTABLE COUNTERWEIGHTED SAFETY TIERS

(71) Applicant: HOIST FITNESS SYSTEMS, INC., Poway, CA (US)

(72) Inventors: Jeffrey O. Meredith, Del Mar, CA (US); Tyler S. Hilderbrand, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 142 days.

(21) Appl. No.: 18/583,111

(22) Filed: Feb. 21, 2024

(65) Prior Publication Data

US 2024/0307731 A1 Sep. 19, 2024

Related U.S. Application Data

(60) Provisional application No. 63/452,308, filed on Mar. 15, 2023.

(51) Int. Cl.
*A63B 21/078* (2006.01)
*A63B 21/00* (2006.01)

(52) U.S. Cl.
CPC ..... *A63B 21/0783* (2015.10); *A63B 21/40* (2015.10); *A63B 2225/093* (2013.01)

(58) Field of Classification Search
CPC ..... A63B 21/0783; A63B 21/40; A63B 21/00047; A63B 21/078; A63B 21/16–169; A63B 21/4027; A63B 2225/093; A63B 23/04–0405; A63B 2023/0411; A63B 2244/09
See application file for complete search history.

(56) References Cited

U.S. PATENT DOCUMENTS 4,799,672 A 1/1989 Barrett
5,727,764 A 3/1998 Angeles
D444,827 S 7/2001 Mobley
(Continued)

FOREIGN PATENT DOCUMENTS

WO 2014107324 A1 7/2014

OTHER PUBLICATIONS

United States International Searching Authority, International Search Report and Written Opinion for corresponding International Application No. PCT/US2024/016657, mailed Jul. 1, 2024, 7 pages.

*Primary Examiner* — Loan B Jimenez
*Assistant Examiner* — Kathleen M Fisk
(74) *Attorney, Agent, or Firm* — David R. Heckadon; Gordon Rees Scully Mansukhani LLP

(57) ABSTRACT

An exercise machine with an adjustable safety tier and rack out hook system, having: (a) a safety tier attached to and moveable along each of a pair of upwardly-extending guide rods, wherein the safety tier can be rotated to a locked position such that the safety tier latches onto the upwardly-extending support member or rotated to an unlocked position; (b) a counterweight connected to each safety tier; and (c) a rack out hook attached to and moveable along each of the upwardly-extending guide rods, wherein the rack out hook can be rotated to a locked position such that the rack out hook latches onto the upwardly-extending support member or rotated to an unlocked position.

13 Claims, 12 Drawing Sheets

(56) References Cited

U.S. PATENT DOCUMENTS

| | | | | |
|---|---|---|---|---|
| 6,551,226 | B1 | 4/2003 | Webber et al. | |
| 6,685,601 | B1 | 2/2004 | Knapp | |
| 6,746,379 | B1 | 6/2004 | Brawner | |
| 7,338,416 | B2 * | 3/2008 | Smith | A63B 21/078 482/106 |
| 7,374,516 | B2 * | 5/2008 | Lundquist | A63B 21/078 482/106 |
| 7,455,629 | B2 * | 11/2008 | Abelbeck | A63B 21/0783 482/110 |
| 7,488,277 | B1 | 2/2009 | Knapp | |
| 7,585,259 | B2 | 9/2009 | Turner | |
| 7,591,771 | B2 | 9/2009 | Redding | |
| 7,815,555 | B2 | 10/2010 | Webber et al. | |
| 8,337,370 | B2 | 12/2012 | Rogers et al. | |
| 8,444,537 | B1 * | 5/2013 | Santoro | A63B 21/00181 482/92 |
| 8,834,329 | B2 | 9/2014 | Kelly | |
| 9,044,643 | B2 | 6/2015 | Staten et al. | |
| 9,216,314 | B2 | 12/2015 | Chen | |
| 9,381,393 | B1 | 7/2016 | Gonzalez | |
| 9,526,938 | B2 * | 12/2016 | Chen | A63B 23/0405 |
| 9,597,539 | B2 | 3/2017 | Grider | |
| D818,547 | S | 5/2018 | Meredith et al. | |
| 10,391,352 | B2 | 8/2019 | Meredith et al. | |
| 10,953,265 | B2 | 3/2021 | Aasa et al. | |
| 10,967,218 | B2 | 4/2021 | Murrell et al. | |
| 11,065,496 | B2 | 7/2021 | Leipheimer | |
| 11,077,332 | B2 | 8/2021 | Fennell | |
| 11,173,337 | B2 | 11/2021 | Jones et al. | |
| 11,278,757 | B2 | 3/2022 | Schmidt et al. | |
| 11,406,862 | B2 | 8/2022 | Downing | |
| 11,524,201 | B2 | 12/2022 | Gore | |
| 12,048,858 | B1 * | 7/2024 | Schroeder | A63B 21/00047 |
| 12,364,896 | B2 * | 7/2025 | Meredith | A63B 21/4035 |
| 2006/0194678 | A1 | 8/2006 | Turner | |
| 2007/0042876 | A1 | 2/2007 | Lundquist | |
| 2007/0203002 | A1 | 8/2007 | Webber | |
| 2008/0004165 | A1 | 1/2008 | Brawner | |
| 2009/0203505 | A1 | 8/2009 | Kroll et al. | |
| 2014/0200117 | A1 | 7/2014 | Grider | |
| 2015/0083681 | A1 | 3/2015 | Childs | |
| 2017/0007877 | A1 | 1/2017 | Leipheimer | |
| 2018/0272176 | A1 | 9/2018 | Aasa et al. | |
| 2018/0353795 | A1 | 12/2018 | Ostmeyer et al. | |
| 2022/0219033 | A1 | 7/2022 | Lee | |
| 2022/0339486 | A1 | 10/2022 | Cahn et al. | |
| 2022/0355154 | A1 | 11/2022 | Cahn et al. | |
| 2024/0198163 | A1 * | 6/2024 | Doan | A63B 21/078 |

* cited by examiner

EXERCISE MACHINE WITH ADJUSTABLE RACK OUT HOOKS AND ADJUSTABLE COUNTERWEIGHTED SAFETY TIERS

RELATED APPLICATION

The present application claims priority to U.S. Provisional Patent Application Ser. No. 63/452,308, of same title, filed Mar. 15, 2023, the entire disclosure of which is incorporated herein by reference in its entirety.

TECHNICAL FIELD

The present system relates to exercise machines in general and to adjustable safety tiers and rack out hooks for use on half-rack machines in particular.

BACKGROUND OF THE INVENTION

Existing half-rack and full-rack (a.k.a. "power-rack") exercise machines are used for squat exercises. In a squat exercise, the user stands under a barbell that has been suspended on a pair of rack out hooks and places the barbell across his/her shoulders. With the barbell across their shoulders, the user then performs a squat exercise. At the end of the exercise, the standing user then places the barbell back onto the pair of rack out hooks.

As can be appreciated, the height of the rack out hooks must be adjusted for users of different heights. It is therefore important that such height adjustments be made easily and quickly, and with minimum potential for the user dropping the hook itself during the height adjustment.

Secondly, half-rack and full-rack exercise machines are also equipped with safety tiers. Safety tiers are positioned below the rack out hooks and are used to catch a barbell should it accidently be dropped by the user, or should the user stumble and fall. In short, safety tiers prevent the user from becoming trapped below a falling barbell. As can be appreciated, different users typically set their safety tiers to different heights. Safety tiers must be strong and sturdy. As a result, they are typically rather heavy. The danger when adjusting the height of standard heavy safety tiers is that the user accidently drops them. In fact, the weight of common safety tiers deter some users from even adjusting them at all. Additionally, the most common designs for safety tiers requires a user to completely remove them from the machine so that the next user must replace them to use the machine safely.

What is therefore desired in both half-rack and full-rack exercise machines are rack out hooks and safety tiers that can be easily and quickly adjusted and are not likely to be accidentally dropped by the user. As will be shown, the present system addresses these concerns.

SUMMARY OF THE INVENTION

In preferred aspects, the present system provides an exercise machine having easily adjustable rack out hooks and easily adjustable counterweighted safety tiers. In preferred aspects, the present system provides an exercise machine having both an adjustable safety tier system and an adjustable rack out hook system. The present system preferably comprises rack out hooks and safety tiers that travel along the guide rods that are positioned next to the system's front support members. The rack out hooks and safety tiers can each be rotated from a position at which they latch onto the front support members to a position at which they unlatch and can then be moved to a different height (and then re-attached onto the front support members). The present rack out hooks and safety tiers may preferably be attached to the guide rods by slidable Delrin®-type bushings.

In preferred aspects, the present system comprises: a frame having a pair of upwardly-extending support members and a pair of upwardly-extending guide rods, wherein one of the guide rods is positioned next to each of the upwardly-extending support members; a safety tier attached to and moveable along each of the upwardly-extending guide rods, wherein the safety tier can be rotated to a locked position such that the safety tier latches onto the upwardly-extending support member or to an unlocked position such that the safety tier disconnects from the upwardly-extending support member and a counterweight connected to each safety tier. Also included are rack out hooks attached to and moveable along each of the upwardly-extending guide rods, wherein each of the rack out hooks can be rotated to a locked position such that the rack out hook latches onto the upwardly-extending support member or to an unlocked position such that the rack out hook disconnects from the upwardly-extending support member.

In preferred aspects, the safety tiers and rack out hooks need only rotate about 20 degrees around the upwardly-extending guide rods from their locked to unlocked positions. The safety tiers and rack out hooks may be moved from their locked to unlocked positions by simply lifting them and rotating them inwardly. Preferably, the upwardly-extending support members have a series of grooves thereon, and the rack out hooks and safety tiers have protrusions thereon that are received into the grooves when the safety tier and the rack out hooks are in their locked positions.

In preferred aspects, the counterweights for the support tiers move up and down within the upwardly-extending support members, thereby protecting the user from contacting them.

Also in preferred aspects, the exercise machine frame further includes base supports connected to the bottom ends of the upwardly-extending support members; upwardly-extending rear supports; a top support connected to the top ends of the upwardly-extending support members; and an optional a pair of lifting handles mounted onto the top support. It is to be understood that the present system can be used both with a half-rack exercise machine (as illustrated) and with a full- or power-rack machine.

One advantage of the present system is that the user does not have to remove either the safety tiers or the rack out hooks from the frame of the machine itself to adjust their respective heights. Specifically, neither the rack out hooks nor the safety tiers are removed from the guide rods, but rather simply travel up and down along them. As such, the danger of the user dropping either the rack out hooks or the (heavier) safety tiers is minimized.

Another advantage of the present system is that the counterweights are attached to the safety tiers and significantly reduce the weight the user has to lift when adjusting the height of the safety tiers. As such, the user can make adjustments quickly and easily with minimum danger of inadvertently dropping a safety tier.

DETAILED DESCRIPTION OF THE DRAWINGS

Figure 1:
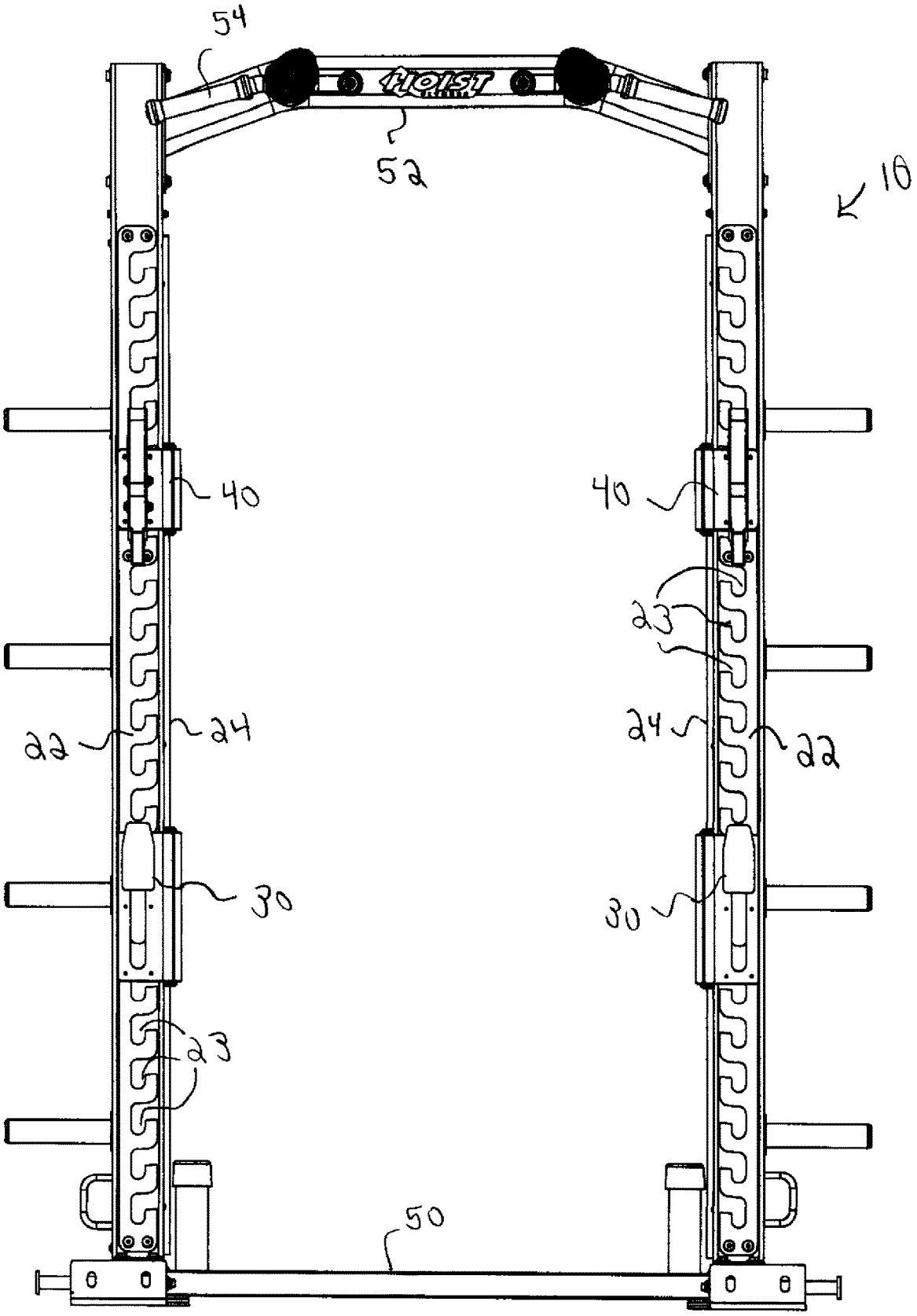
FIG. 1 is a front elevation view of the present system.
Figure 2:
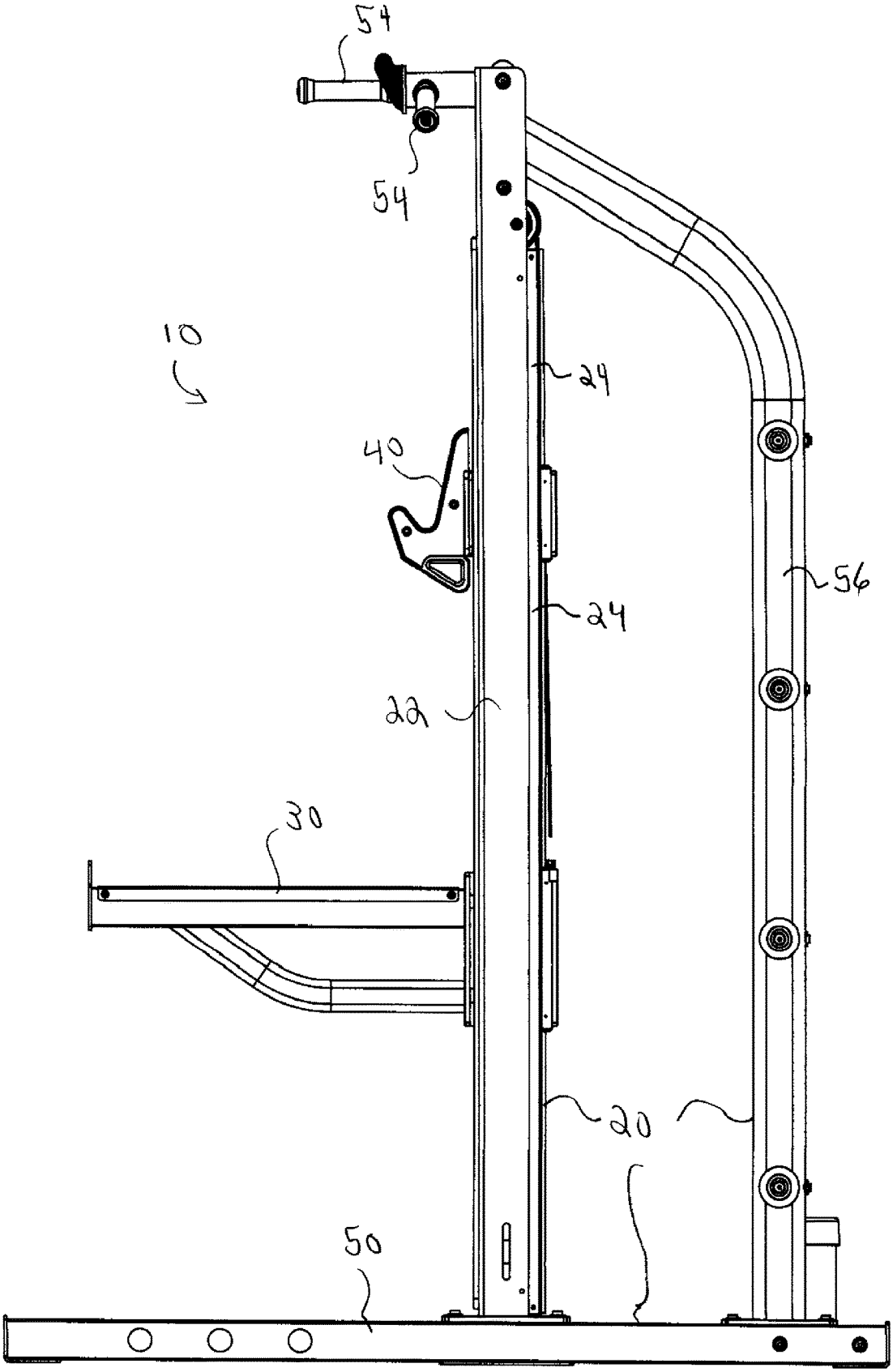
FIG. 2 is a side elevation view of the present system.
Figure 3:
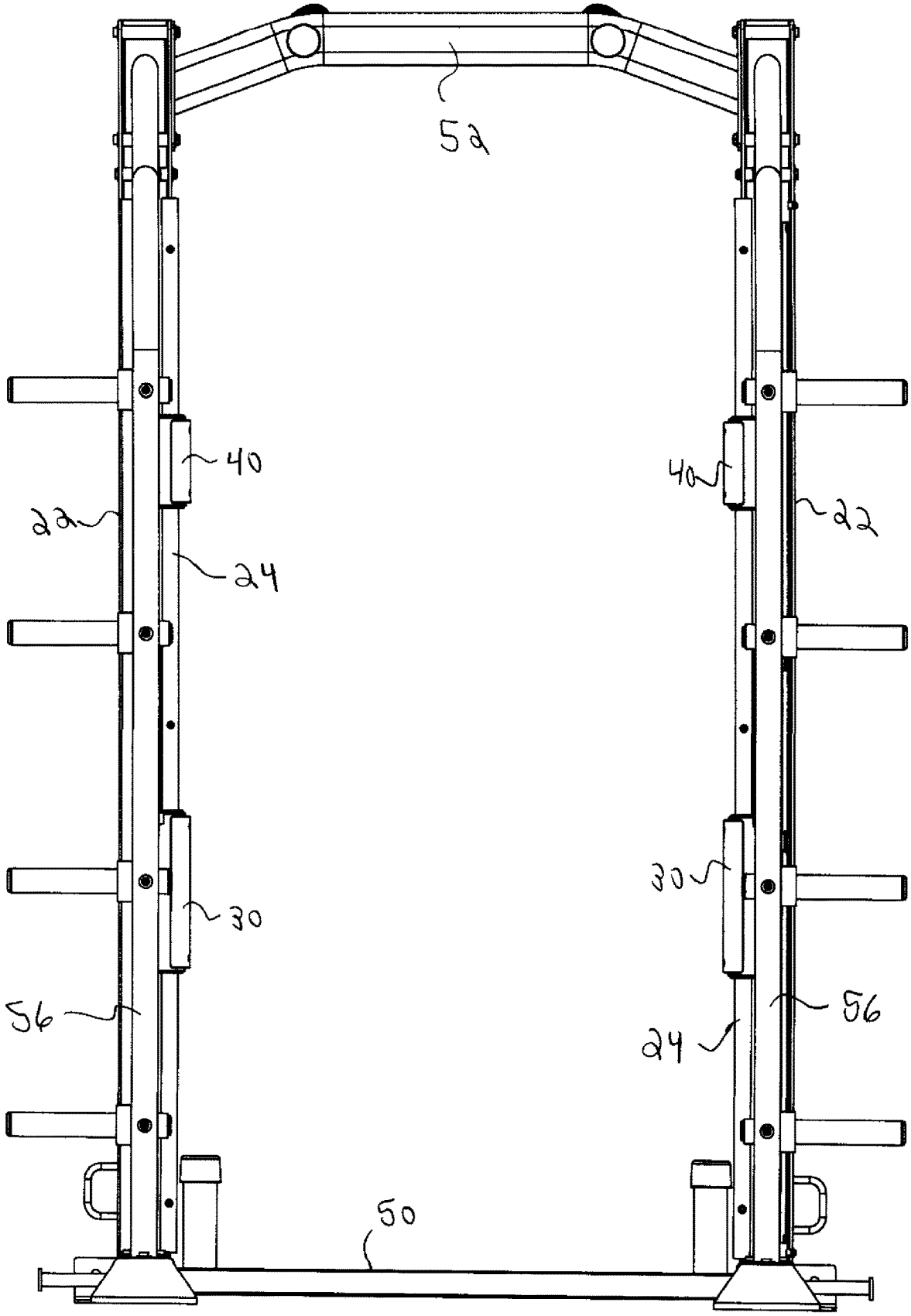
FIG. 3 is a rear elevation view of the present system.
Figure 4:
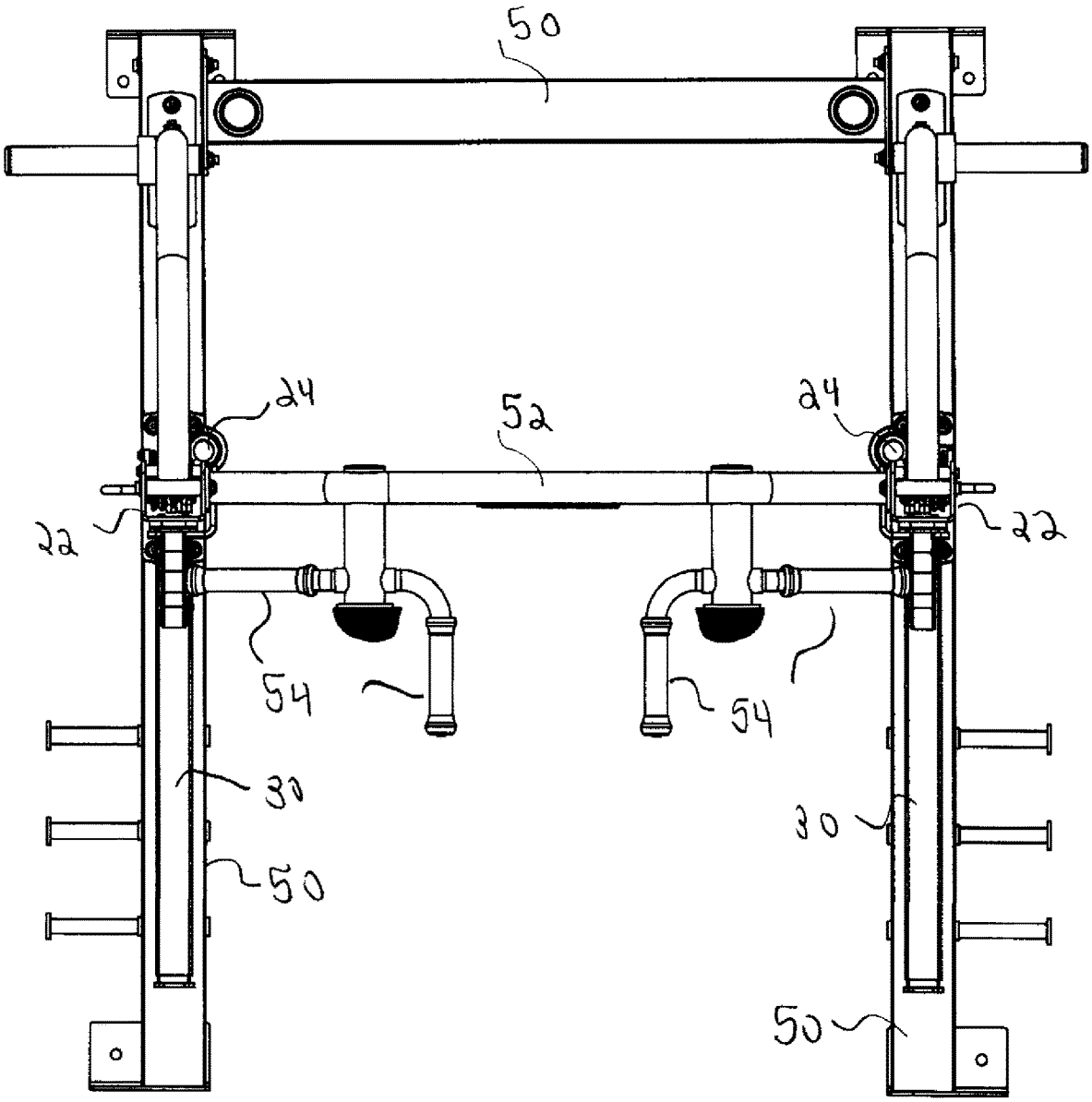
FIG. 4 is a top plan view of the present system.
Figure 5:
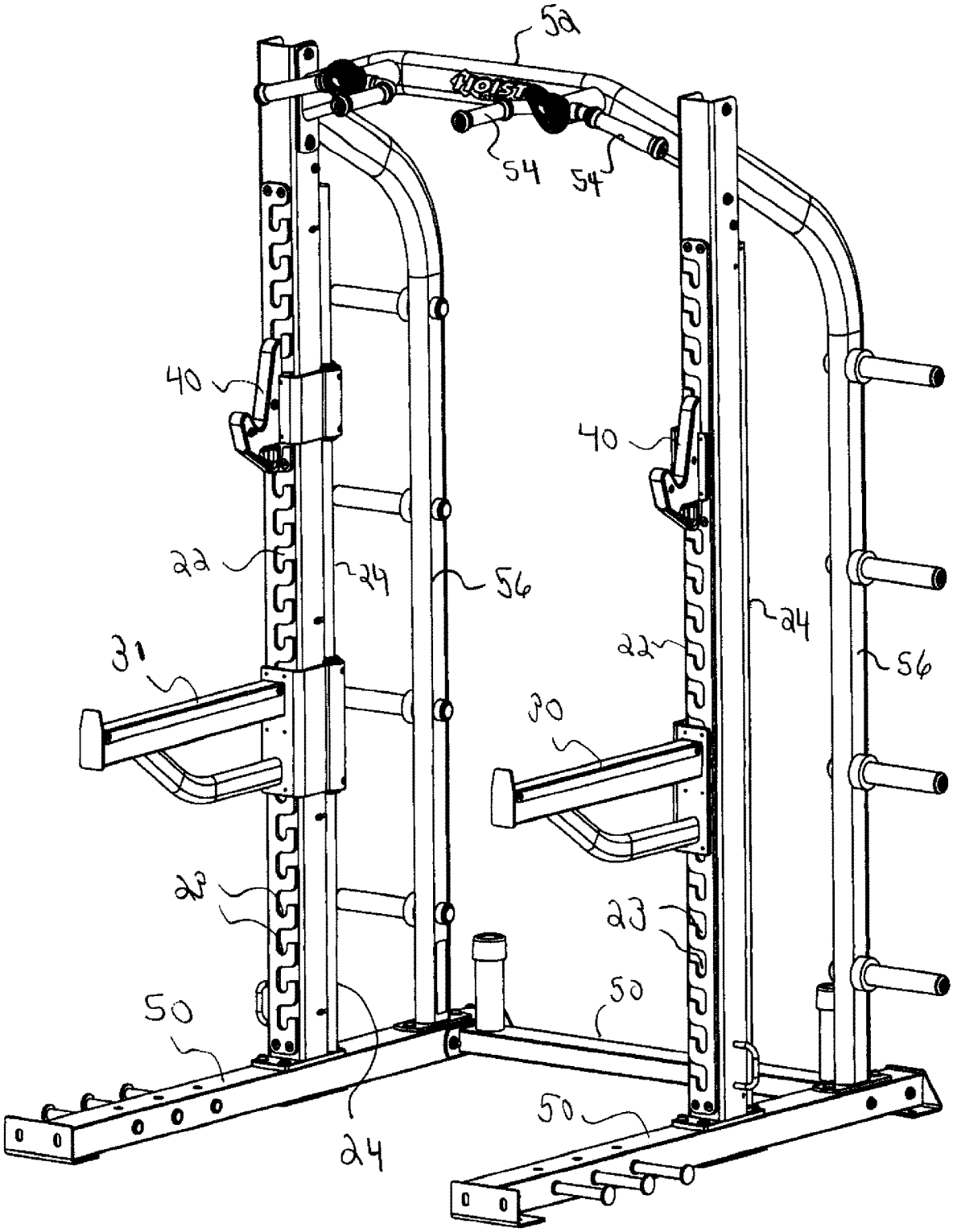
FIG. 5 is a front perspective view of the present system.

FIGS. 1 to 5 show various views of the present exercise machine 10 which provides an adjustable safety tier and rack out hook system, as follows. Exercise machine 10 comprises: a frame 20 having a pair of upwardly-extending support members 22 and a pair of upwardly-extending guide rods 24. As can be seen, one of the guide rods 24 is positioned next to each of the upwardly-extending support members 22. Also included are safety tiers 30 which are attached to (and slidably moveable along) each of the upwardly-extending guide rods 24. As will be illustrated fully herein, each safety tier 30 can be rotated into a locked position such that the safety tier latches onto the upwardly-extending support member 22 or into an unlocked position such that the safety tier 30 disconnects from the upwardly-extending support member 22. In addition, a counterweight 35 is connected by cable to each safety tier 30. Also included are rack out hooks 40 attached to and moveable along each of the upwardly-extending guide rods 24.

In preferred aspects, frame 10 further includes horizontal base supports 50 which may be connected to the bottom ends of upwardly-extending support members 22. Frame 10 may also include a top support 52 connected to the top ends of the upwardly-extending support members 22. In optional aspects, top support 52 may also include a pair of lifting handles 54 and/or gripping pads or supports attached thereto. Frame 10 may also include a pair of upwardly-extending rear supports 56 connected both to base supports 50 and to top support 52. As illustrated, the present exercise machine system can be used with a half-rack exercise machine. It is to be understood, however, that the present exercise system can also be used with a full- or power-rack exercise machine, all keeping within the scope of the present invention.

Figure 10A:
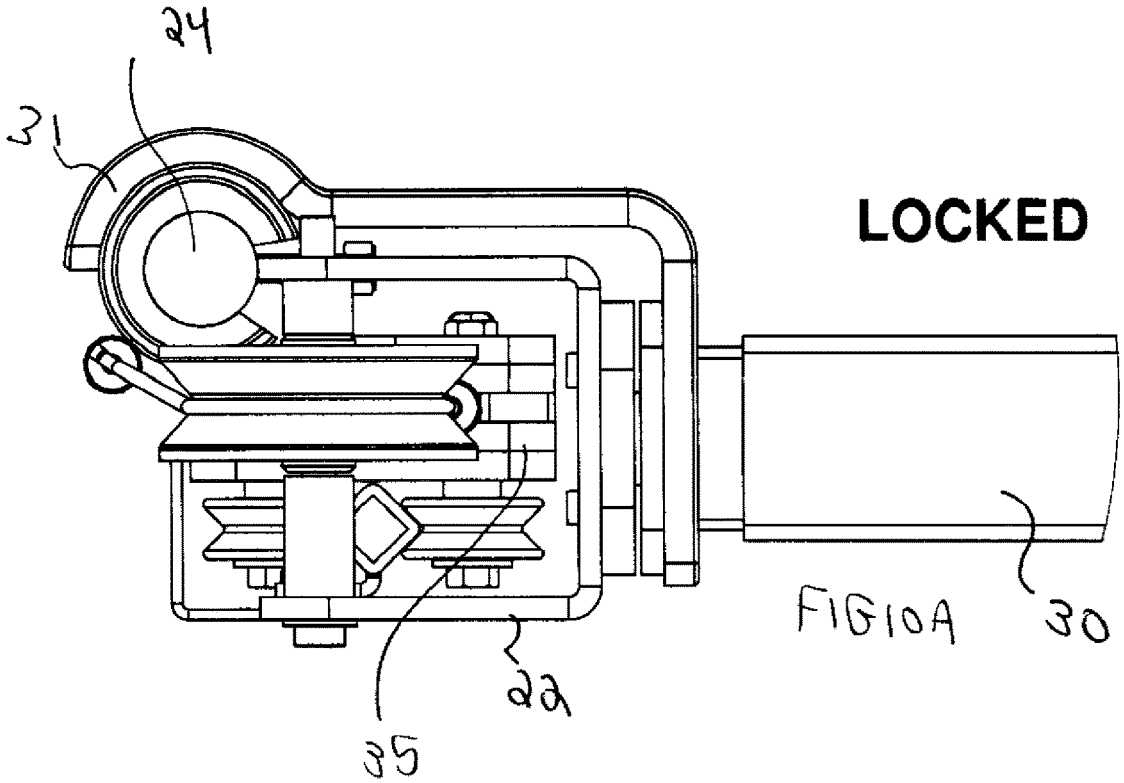
FIG. 10A is a top sectional view of the safety tier in a locked position.
Figure 10B:
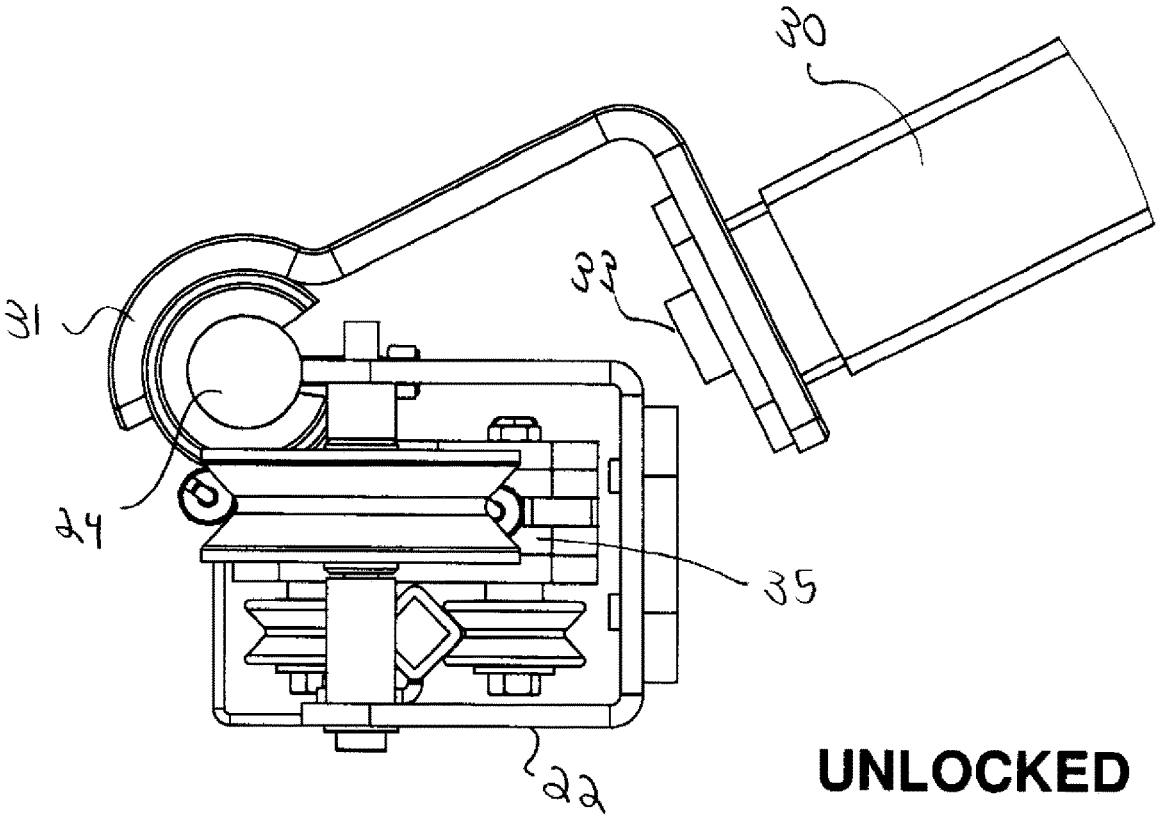
FIG. 10B is a top sectional view of the safety tier in an unlocked position.
Figure 11A:
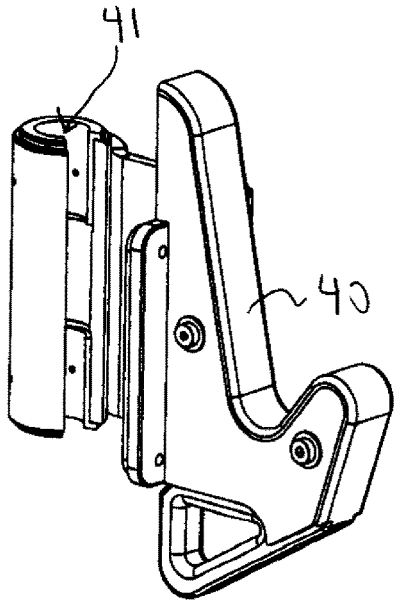
FIG. 11A is a perspective view of one of the rack out hooks.
Figure 11B:
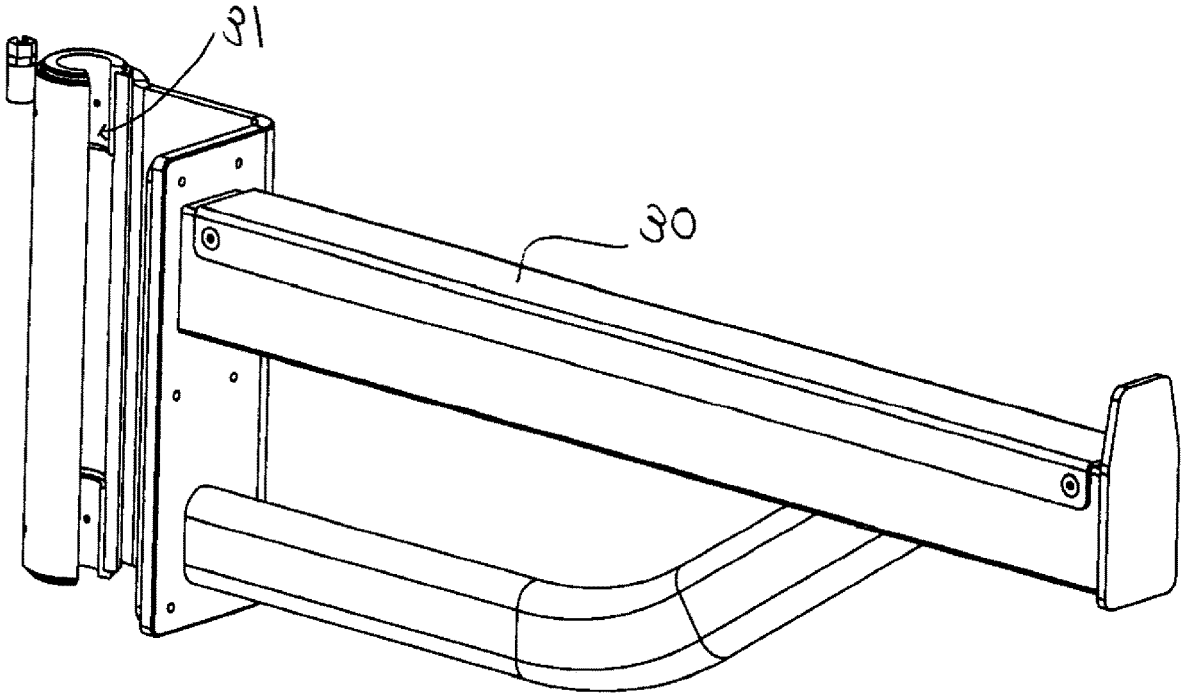
FIG. 11B is a perspective view of one of the safety tiers.

As will be explained herein, rack out hooks 40 can be rotated into a locked position (FIG. 10A) such that the rack out hook latches onto the upwardly-extending support member or into an unlocked position (FIG. 10B) such that the rack out hook disconnects from the upwardly-extending support member.

FIGS. 6 to 12B show further details of the preferred locking and unlocking operation of the safety tiers 30 and rack out hooks 40, as follows. Safety tiers 30 and rack out hooks 40 are preferably attached to the upwardly-extending guide rods 24 by slidable Delrin®-style bushings. As such, the safety tiers 30 and hook out racks 40 can be conveniently slid up and down guide rods 25. In addition, safety tiers 30 and rack out hooks 40 each rotate around the upwardly-extending guide rods 24 from their locked to unlocked positions. This rotation is best seen in FIGS. 10A to 10B, and in FIGS. 11A and 11B where safety tier 30 has a curved portion 31 that is received around guide rod 24 and rack out hook 40 similarly has a curved portion 41 that is also received around guide rod 24. As can be seen, the safety tiers 30 and rack out hooks 40 can each be rotated as little as approximately 20 degrees when moved between their locked and unlocked positions (FIGS. 10A and 10B).

Figure 6:
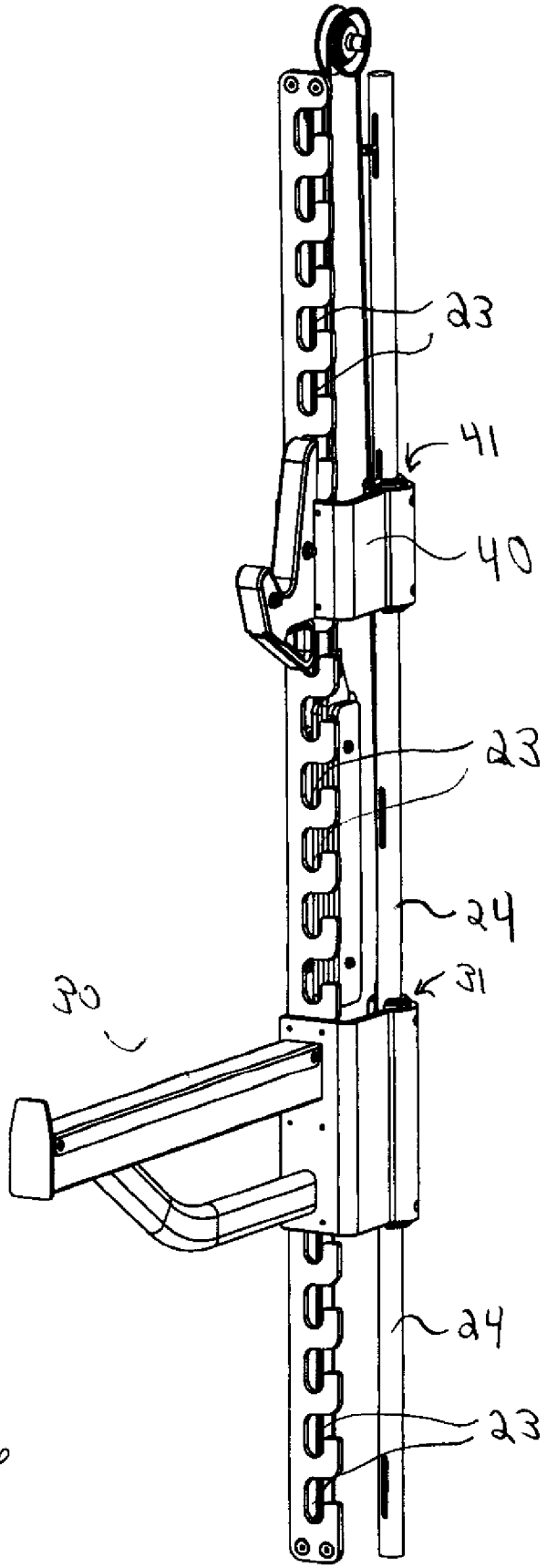
FIG. 6 is a close-up front perspective view of a safety tier and rack out hook of the present system.
Figure 9:
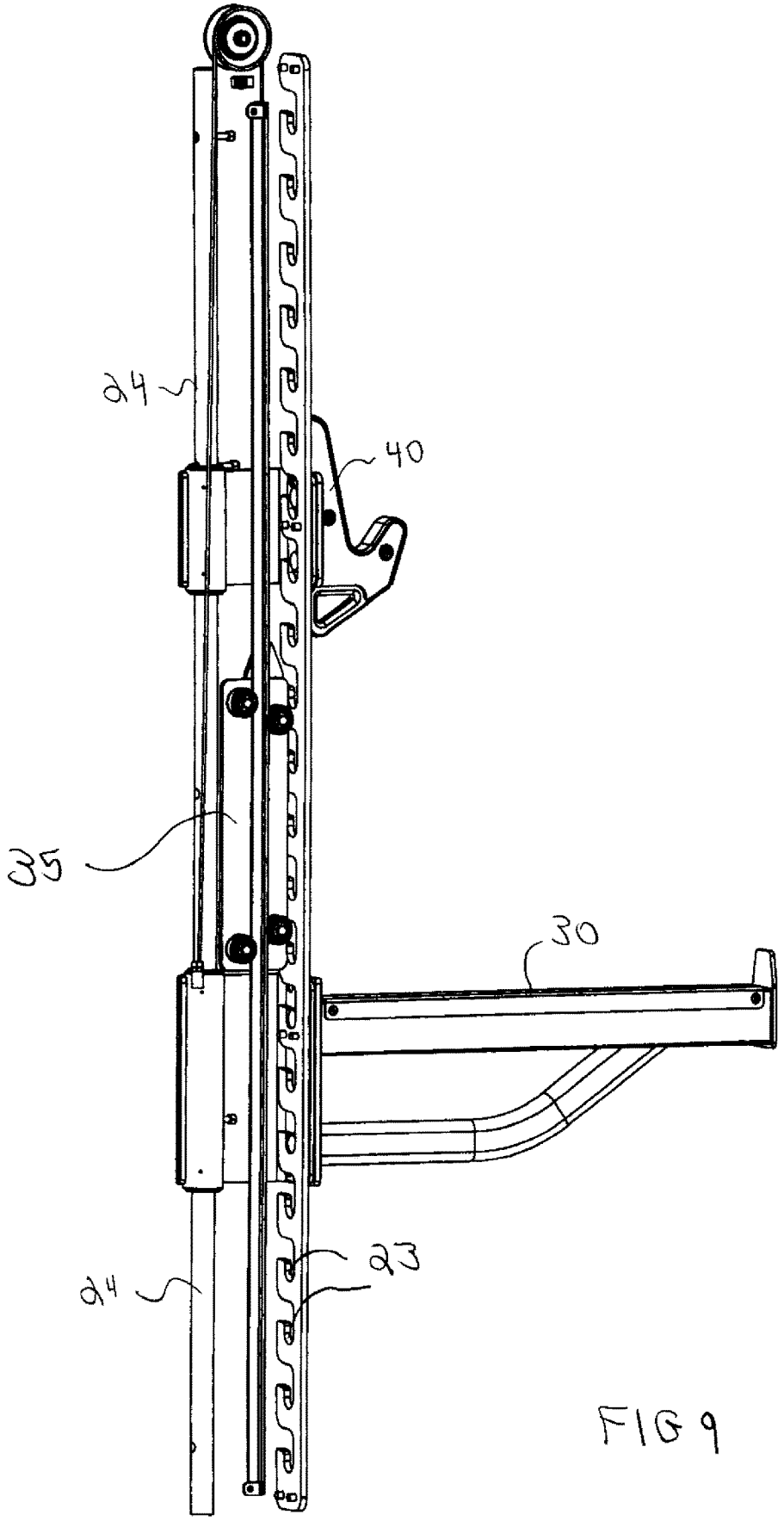
FIG. 9 is a side elevation view showing the safety tier and rack out hook in the locked position.
Figure 12A:
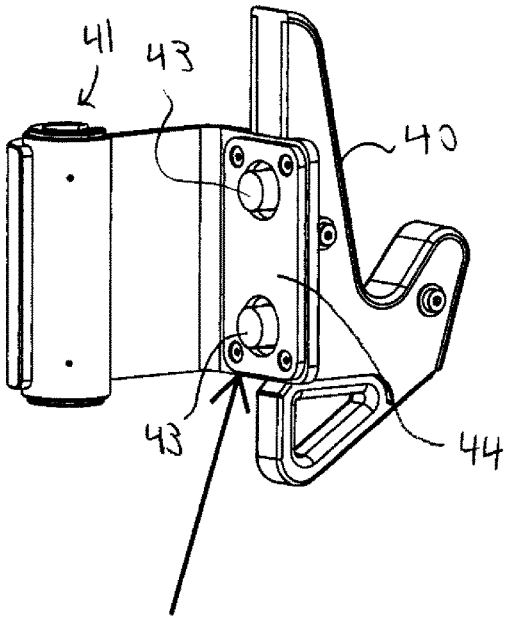
FIG. 12A is a rear perspective view of one of the rack out hooks showing a preferred wear plate.
Figure 12B:
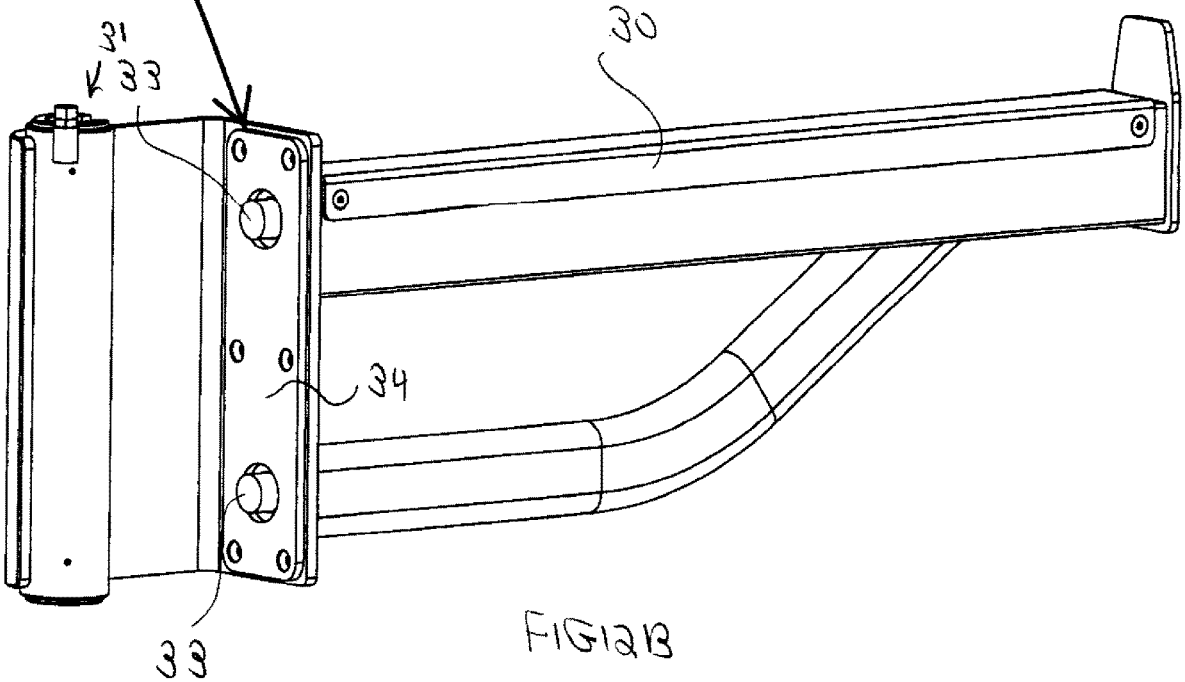
FIG. 12B is a rear perspective view of one of the safety tiers showing a preferred wear plate.

As best seen in FIGS. 6 and 9, safety tiers 30 and rack out hooks 40 are moved from their locked to unlocked positions by lifting them and rotating them inwardly (i.e.: towards the center of the exercise machine). As can be seen, each of the upwardly-extending support members 22 preferably has a series of grooves 23 thereon, and (as seen in FIGS. 12A and 12B), the safety tier 30 and the rack out hook 40 also have protrusions 33 and 43 thereon that are received into grooves 23 when the safety tiers 30 and the rack out hooks 40 are in their locked positions. (It is to be understood that the illustrated protrusions 33 and 43 in FIGS. 12A and 12B may be extended to have a widened base portion that locks securely behind grooves 23). The series of grooves 23 are preferably positioned on the front facing side of the upwardly-extending supports 22 as illustrated, with the guide rods 24 being positioned behind the upwardly-extending supports. In addition, safety tiers 30 and rack out hooks 40 preferably further comprise wear plates 34 and 44 that are positioned against the upwardly-extending support member 22 when the safety tiers 30 and rack out hooks 40 are in their locked positions.

Figure 7:
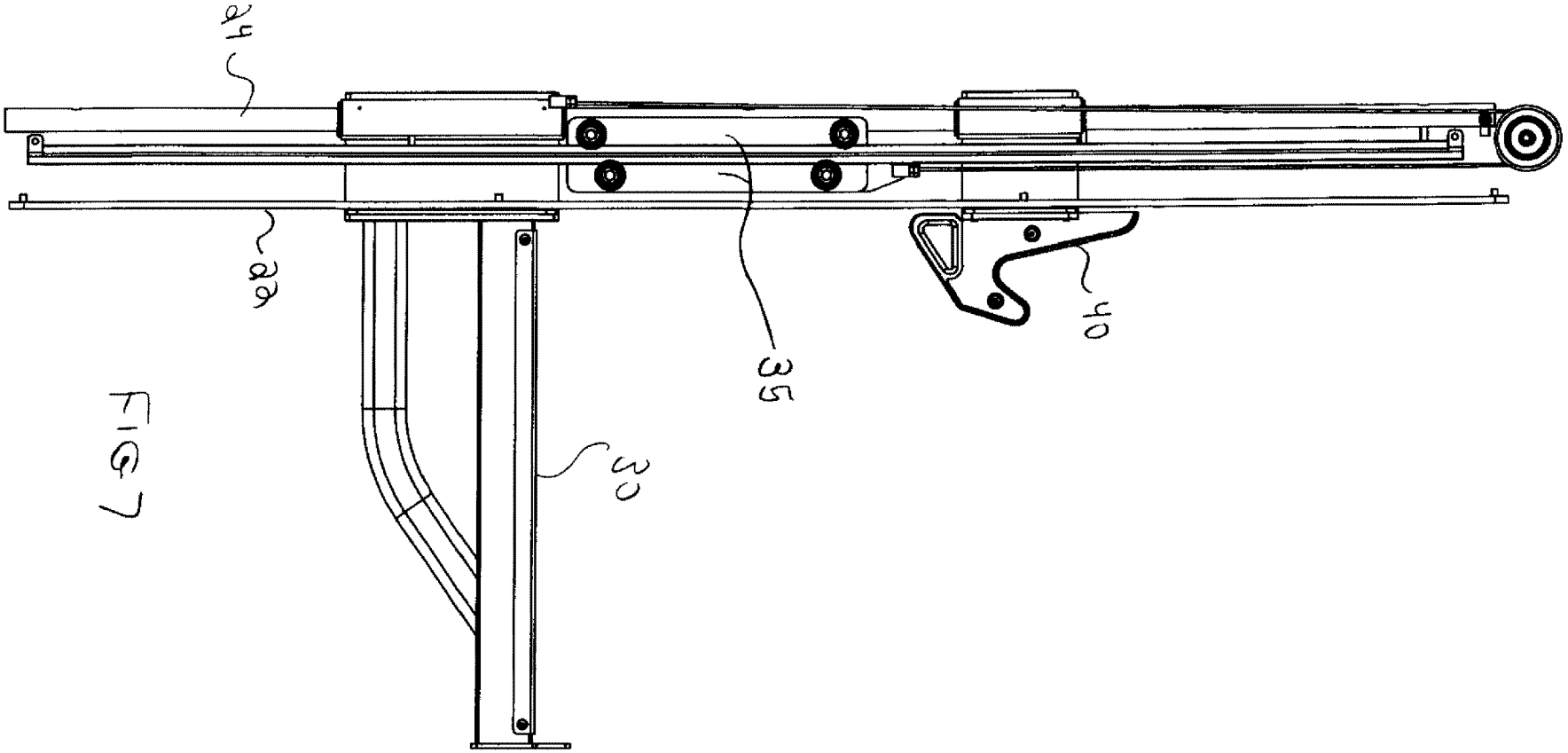
FIG. 7 is a sectional side elevation view corresponding to FIG. 6, showing the operation of a counterweight for moving the safety tier.
Figure 8:
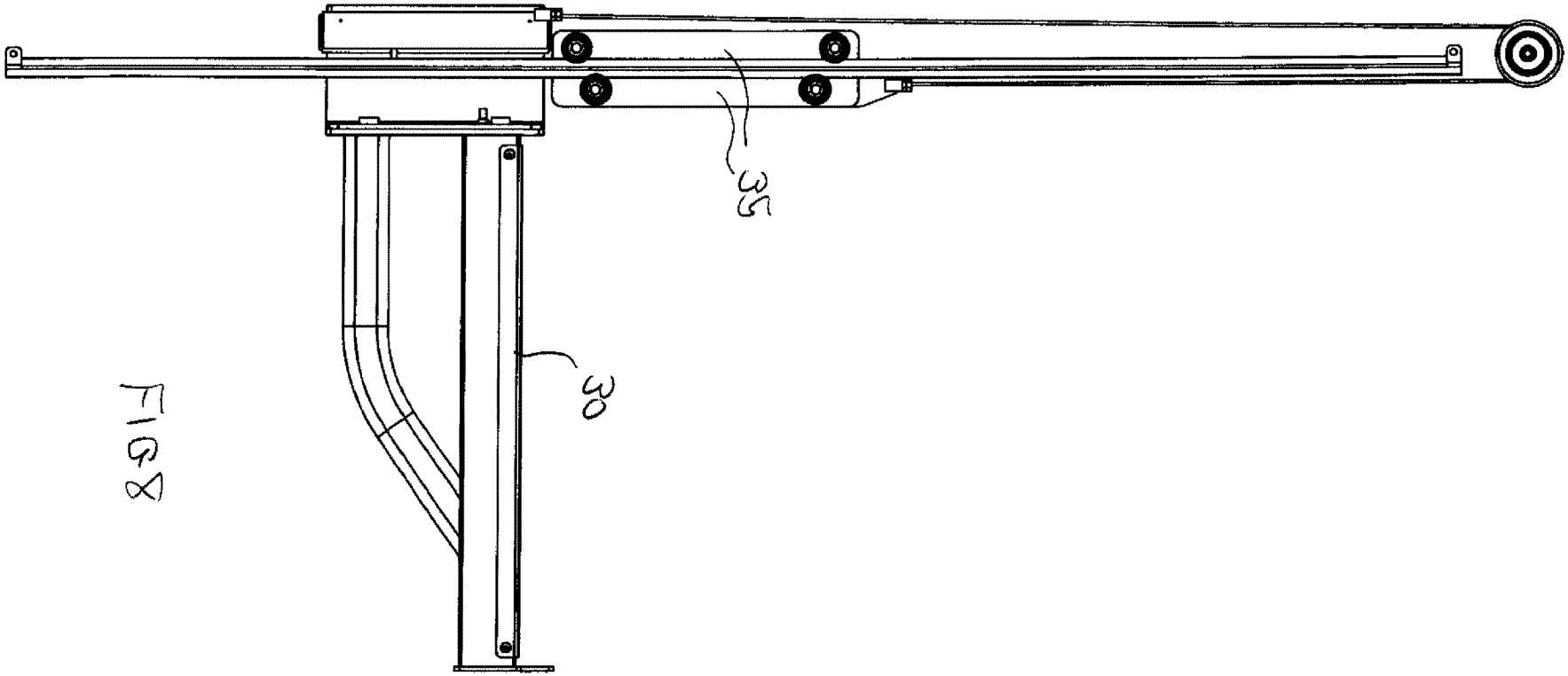
FIG. 8 corresponds to FIG. 7, but with the rack out hook removed.

Lastly, as seen in FIGS. 7, 8 and 9, the cable-connected counterweight 35 moves up and down within the upwardly-extending support member 22 as the safety tier 30 is raised or lowed. This is very beneficial since safety tiers can often weigh on the order of 45 lbs. For example, using a 30 lb counterweight 35 would therefor reduce the user's handling weight when lifting them to only 10 lbs.

What is claimed is:

1. An exercise machine having an adjustable safety tier and rack out hook system, comprising:

a frame comprising:

a pair of upwardly-extending support members, and a pair of upwardly-extending guide rods, wherein one of the guide rods is positioned next to each of the upwardly-extending support members;

a safety tier attached to and moveable along each of the upwardly-extending guide rods, wherein the safety tier is configured to be rotated to a locked position such that the safety tier latches onto a respective one of the upwardly-extending support members or to an unlocked position such that the safety tier disconnects from the respective upwardly-extending support member;

a counterweight connected to each safety tier; and a rack out hook attached to and moveable along each of the upwardly-extending guide rods, wherein the rack out hook is configured to be rotated to a locked position such that the rack out hook latches onto a respective one of the upwardly-extending support members or to an unlocked position such that the rack out hook disconnects from the respective upwardly-extending support member and wherein the safety tiers and rack out hooks each rotate around the upwardly-extending guide rods from their locked to unlocked positions.

2. The machine of claim 1, wherein the frame further comprises base supports connected to bottom ends of the upwardly-extending support members.

3. The machine of claim 2, wherein the frame further comprises a top support connected to top ends of the upwardly-extending support members.

4. The machine of claim 3, further comprising a pair of lifting handles on the top support.

5. The machine of claim 2, further comprising a pair of upwardly-extending rear supports connected to the base supports and the top support.

6. The machine of claim 1, wherein each of the upwardly-extending support members have a series of grooves thereon, and wherein the safety tiers and the rack out hooks have protrusions thereon that are received into the grooves when the safety tiers and the rack out hooks are in their locked positions.

7. The machine of claim 6, wherein the safety tiers and rack out hooks further comprise a wear plate that is positioned against the respective upwardly-extending support member when the safety tiers and rack out hooks are in their locked positions.

8. The machine of claim 6, wherein the series of grooves are on a front of the upwardly-extending support members, and the guide roda are positioned behind the upwardly-extending support members.

9. The machine of claim 1, wherein the safety tiers and rack out hooks are attached to the upwardly-extending guide rods by slidable bushings.

10. The machine of claim 1, wherein the safety tiers and rack out hooks each rotate approximately 20 degrees between their locked and unlocked positions.

11. The machine of claim 1, wherein the safety tiers and rack out hooks are moved from their locked to unlocked positions by lifting them and rotating them inwardly.

12. The machine of claim 1, wherein each counterweight moves up and down within a respective one of the upwardly-extending support members.

13. The machine of claim 1, wherein each safety tier and counterweight are connected by a cable passing within the respective upwardly-extending support member.

* * * * *